US011904382B2

(12) United States Patent
Eguchi et al.

(10) Patent No.: US 11,904,382 B2
(45) Date of Patent: Feb. 20, 2024

(54) PRESS APPARATUS

(71) Applicant: DAI-ICHI DENTSU LTD., Chofu (JP)

(72) Inventors: Takeshi Eguchi, Tokyo (JP); Takahiro Inoue, Tokyo (JP); Masakazu Miyata, Gifu (JP)

(73) Assignee: DAI-ICHI DENTSU LTD., Chofu (JP)

( * ) Notice: Subject to any disclaimer, the term of this patent is extended or adjusted under 35 U.S.C. 154(b) by 251 days.

(21) Appl. No.: 17/614,953

(22) PCT Filed: Jan. 17, 2020

(86) PCT No.: PCT/JP2020/001594
§ 371 (c)(1),
(2) Date: Nov. 29, 2021

(87) PCT Pub. No.: WO2021/144991
PCT Pub. Date: Jul. 22, 2021

(65) Prior Publication Data

US 2022/0080492 A1 Mar. 17, 2022

(51) Int. Cl.
*B21J 15/26* (2006.01)
*B21J 15/10* (2006.01)

(52) U.S. Cl.
CPC ..... *B21J 15/26* (2013.01); *B21J 15/10* (2013.01)

(58) Field of Classification Search
CPC ..... B21J 15/10; B21J 15/025; B21J 15/105; B21J 15/26; B21J 15/28; B21J 15/285; Y10T 29/53422; Y10T 29/49771; Y10T 29/5377; Y10T 29/49764; Y10T 29/5343; Y10T 29/53039; Y10T 29/5307;
(Continued)

(56) References Cited

U.S. PATENT DOCUMENTS 5,169,047 A * 12/1992 Endres ..... B21J 15/10 227/27
6,942,134 B2 * 9/2005 Naito ..... B21J 15/025 227/51

(Continued)

FOREIGN PATENT DOCUMENTS

CA 2504221 A1 5/2004
CN 103991230 A 8/2014

(Continued)

OTHER PUBLICATIONS

Office Action and Search Report from the Chinese Patent Office dispatched Feb. 11, 2023 in related CN application No. 202080037923.8, and translation thereof.

(Continued)

*Primary Examiner* — Nathaniel C Chukwurah
(74) *Attorney, Agent, or Firm* — J-TEK LAW PLLC; Jeffrey D. Tekanic; Scott T. Wakeman

(57) ABSTRACT

A compact press apparatus is provided that is capable of assuring the acceptability of a pressing, and in which the pressing location tends not to be restricted. Such a press apparatus includes a frame (1, 77) and a servopress (31, 50, 60, 101). A servomotor (33, 52, 62, 103) is provided within a first frame part (11, 17, 19, 79) or within a connecting-frame part (15, 83). At least a portion of a power-transmission mechanism (40, 56, 66, 90, 110) is provided within the first frame part (15, 83).

11 Claims, 5 Drawing Sheets

(58) Field of Classification Search
CPC ..... Y10T 29/53013; Y10T 29/53496; Y10T 29/53009
See application file for complete search history.

(56) References Cited

U.S. PATENT DOCUMENTS

| | | | | |
|---|---|---|---|---|
| 6,951,052 | B2 * | 10/2005 | Clew | B21J 15/28 29/407.03 |
| 7,032,296 | B2 * | 4/2006 | Zdravkovic | B21J 15/025 411/501 |
| 2002/0029450 | A1 | 3/2002 | Kondo | |
| 2021/0046593 | A1 | 2/2021 | Eguchi et al. | |
| 2021/0046680 | A1 | 2/2021 | Eguchi et al. | |

FOREIGN PATENT DOCUMENTS

| | | | |
|---|---|---|---|
| CN | 103991230 | A | 8/2014 |
| CN | 104525678 | A | 4/2015 |
| CN | 104525678 | A | 4/2015 |
| CN | 105268900 | A | 1/2016 |
| CN | 106391974 | A | 2/2017 |
| CN | 108215266 | A | 6/2018 |
| CN | 108215266 | A | 6/2018 |
| EP | 2319635 | B1 | 9/2014 |
| JP | H1147998 | A | 2/1999 |
| JP | 2001001050 | A | 1/2001 |
| JP | 2001001050 | A | 1/2001 |
| JP | 2001191129 | A | 7/2001 |
| JP | 2001232437 | A | 8/2001 |
| JP | 2003305531 | A | 10/2003 |
| JP | 2003305531 | A | 10/2003 |
| JP | 2006504533 | A | 2/2006 |
| JP | 2006062064 | A | 3/2006 |
| JP | 2006062064 | A | 3/2006 |
| JP | 2007203307 | A | 8/2007 |
| JP | 2013510004 | A | 3/2013 |
| JP | 2013510004 | A | 3/2013 |
| KR | 20090100977 | A | 9/2009 |
| WO | 2019013006 | A1 | 1/2019 |
| WO | 2019013007 | A1 | 1/2019 |

OTHER PUBLICATIONS

English translation of the International Preliminary Report on Patentability for parent application No. PCT/JP2020/001594.
English translation of the International Search Report dated Mar. 31, 2021, for parent application No. PCT/JP2020/001594.
Machine English translation of the Written Opinion dated Mar. 31, 2021, for parent application No. PCT/JP2020/001594.
Communication from the EPO dispatched Oct. 18, 2023, in counterpart EP application No. 20913078.0, including European Search Opinion, European Supplementary Search Report and examined claims 1-9.
Second Office Action from the Chinese Patent Office dispatched Sep. 28, 2023 in related CN application No. 2020800379236.8, and translation thereof.

* cited by examiner

PRESS APPARATUS

CROSS-REFERENCE

The present application is the US national stage of International application serial no. PCT/JP2020/001594 filed on Jan. 17, 2020.

TECHNICAL FIELD

The present invention generally relates to a press apparatus.

BACKGROUND ART

Known press apparatuses are disclosed, e.g., in WO 2019/013006 and WO 2019/013007. Each of these known press apparatuses comprises a frame and a servopress, which is provided on the frame.

The frame comprises a first frame part, a second frame part, which faces the first frame part in a first direction, and a connecting-frame part, which connects the first frame part and the second frame part. Overall, the frame has a C shape or a U shape.

The servopress comprises a servomotor, a ram, a power-transmission mechanism, and a load-measuring means. The servomotor is operated by a controller and causes a rotary shaft to rotate. The ram is capable of reciprocating motion in a first direction between the first frame part and the second frame part; a die or the like is fixed to the ram. The power-transmission mechanism converts the rotation of the rotary shaft into reciprocating motion of the ram. The load-measuring means is capable of measuring the load on the ram.

The press apparatus is provided on, for example, a robot arm and is capable of pressing, via the die or the like, rivets or the like at various locations. In particular, because the press apparatus can measure, using the load-measuring means, the load on the ram during pressing, the press apparatus is also capable of assuring the acceptability of the pressing.

SUMMARY OF THE INVENTION

However, with regard to the above-mentioned known press apparatus, because the servomotor and the power-transmission mechanism are provided outside of the frame, the entirety of the servomotor and the power-transmission mechanism protrudes from the frame, thus increasing the size of the press apparatus. Consequently, in an embodiment in which the press apparatus is provided on, for example, a robot arm, limits to the movement of the robot arm tend to occur, and therefore the locations at which the rivet or the like is pressed tend to be restricted.

It is therefore one, non-limiting object of the present teachings to disclose techniques for making a compact press apparatus that is capable of assuring the acceptability of pressing and in which the pressing location tends not to be restricted.

In one aspect of the present teachings, a press apparatus may comprise: a frame that comprises a first frame part, a second frame part, which faces the first frame part in a first direction, and a connecting-frame part (which may be alternately called a frame-connecting part), which connects the first frame part and the second frame part; and a servopress, which is provided on the frame, comprising a servomotor, which causes a rotary shaft to rotate, a ram, which is capable of reciprocating motion in the first direction between the first frame part and the second frame part, a power-transmission mechanism that converts the rotation of the rotary shaft into reciprocating motion of the ram, and a load-measuring means that is capable of measuring the load on the ram, wherein:

the servomotor is provided within the first frame part or within the connecting-frame part; and at least a portion of the power-transmission mechanism is provided within the first frame part.

In such an exemplary press apparatus, because the servomotor is provided within the first frame part or within the connecting-frame part and because at least a portion of the power-transmission mechanism is provided within the first frame part, the portion that protrudes from the frame can be made small or can even be eliminated. In addition, in this press apparatus, the load on the ram during pressing also can be measured.

Accordingly, such an exemplary press apparatus can assure the acceptability of the pressing, is compact, and tends not to be limited with respect to the pressing location.

The power-transmission mechanism may comprise a nut extending in the first direction, a screw shaft extending in the first direction within the nut, and a plurality of balls disposed between the nut and the screw shaft. In addition, one of the nut and the screw shaft may be rotationally driven by the rotary shaft. Furthermore, the other of the nut and the screw shaft may be formed integrally with the ram in the state in which, while transmitting a load, it is non-rotatable relative to the frame owing to a linear-motion mechanism having a rotation-stopping function. In such an embodiment, a ball-screw mechanism, which is widely used in servopresses, can constitute the power-transmission mechanism, and thereby simplification of the structure can be achieved.

In an embodiment in which the ball-screw mechanism constitutes the power-transmission mechanism, preferably the nut is rotationally driven by the rotary shaft. In addition, the linear-motion mechanism is preferably a linear-motion guide that comprises a guide part provided on the frame and extending in the first direction and a guided part provided on the screw shaft or the ram and guided by the guide part. In such an embodiment, the overall length of the ball-screw mechanism of the power-transmission mechanism can be shortened more than in an embodiment in which the screw shaft is rotationally driven by the rotary shaft. In addition, because the screw shaft is integral with the ram and because the linear-motion mechanism can be constituted by a simple linear-motion guide, simplification of the structure can be better achieved.

In the alternative, the power-transmission mechanism may comprise a nut extending in the first direction, a screw shaft extending in the first direction within the nut, and a plurality of planetary-roller screws disposed between the nut and the screw shaft. In addition, one of the nut and the screw shaft may be rotationally driven by the rotary shaft. Furthermore, the other of the nut and the screw shaft may be formed integrally with the ram in the state in which, while transmitting a load, it is non-rotatable relative to the frame owing to a linear-motion mechanism having a rotation-stopping function. In such an embodiment, because the planetary-roller screw mechanism constitutes the power-transmission mechanism, which can transmit a large load, the load that can be applied by the press apparatus can be made large. In addition, because the pitch (lead) of the planetary-roller screw mechanism is fine, a speed-reducing mechanism can be made unnecessary, and thereby a more compact press apparatus can be achieved.

In such an exemplary embodiment in which the planetary-roller screw mechanism constitutes the power-transmission mechanism, the screw shaft is preferably rotationally driven by the rotary shaft. In addition, the linear-motion mechanism is preferably a ball spline comprising a first ball groove provided on the first frame part and extending in the first direction, a second ball groove provided on the nut and extending in the first direction, and a plurality of balls provided between the first ball groove and the second ball groove. In such an embodiment, because the nut is integral with the ram and because the linear-motion mechanism is constituted by a ball spline, whose volume is smaller than that of the linear-motion guide, a more compact press apparatus can be achieved.

The servomotor may comprise a rotor, which rotates integrally with the rotary shaft, and a stator. The connecting-frame part or the first frame part preferably fixes the stator. In such an embodiment, because the connecting-frame part or the first fame part also serves as a motor housing, a motor housing becomes unnecessary, and therefore a reduction in manufacturing cost can be achieved owing to a reduction in the part count.

The press apparatus of the present teachings may have only one servopress or may have two or more servopresses. In an exemplary embodiment in which there is only one servopress, the servomotor is provided within the first frame part or within the connecting-frame part of the frame. That is, the portion of the frame in which the servomotor is not provided is the second frame part. In an embodiment in which there are two servopresses, the press apparatus of the present teachings can comprise a second servopress, which is provided on the frame. The second servopress may comprise a second servomotor, which causes a second rotary shaft to rotate, a second ram, which is capable of reciprocating motion in the first direction between the first frame part and the second frame part, a second power-transmission mechanism, which converts the rotation of the second rotary shaft to reciprocating motion of the second ram, and a second load-measuring means, which is capable of measuring the load of the second ram. Furthermore, the ram and the second ram preferably face one another. In such an embodiment, it is possible to press a workpiece from both sides using the ram and the second ram.

Press apparatuses of the present teachings are capable of assuring the acceptability of the pressing, is more compact than those in the past, and tends not to be limited with respect to the pressing location. Consequently, in an exemplary embodiment in which the press apparatus is provided on, for example, a robot arm, limitations on the movement of the robot arm tend not to occur, and pressure can be applied to rivets or the like at various locations.

DETAILED DESCRIPTION OF EMBODIMENTS OF THE PRESENT DISCLOSURE

Working Examples 1-3, which are exemplary, non-limiting embodiments of the present teachings, will be explained below, with reference to the drawings.

Working Example 1

Figure 1:
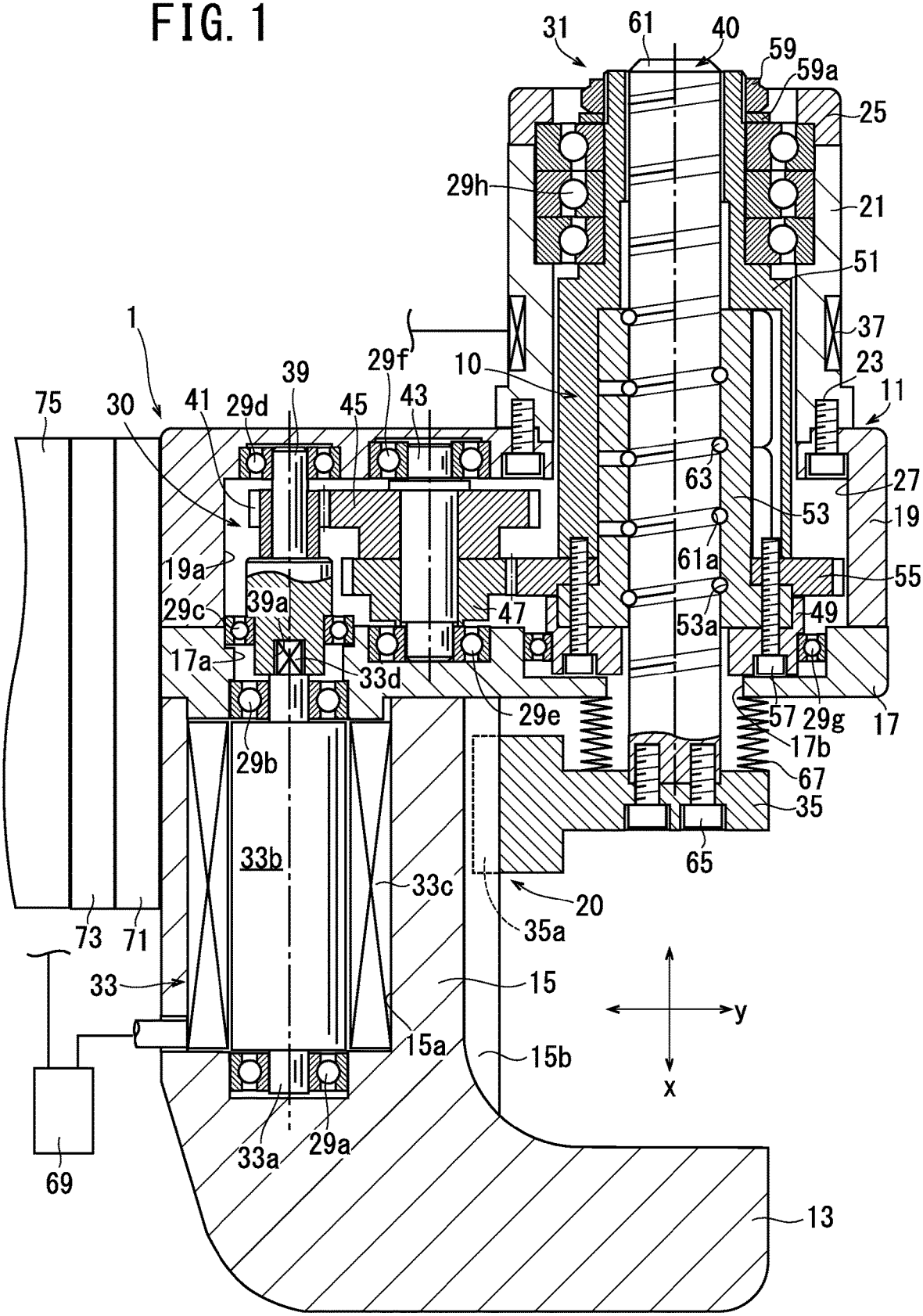
FIG. 1 is a cross-sectional view of the state in which a ram has been raised, according to a press apparatus of Working Example 1 of the present teachings.
Figure 2:
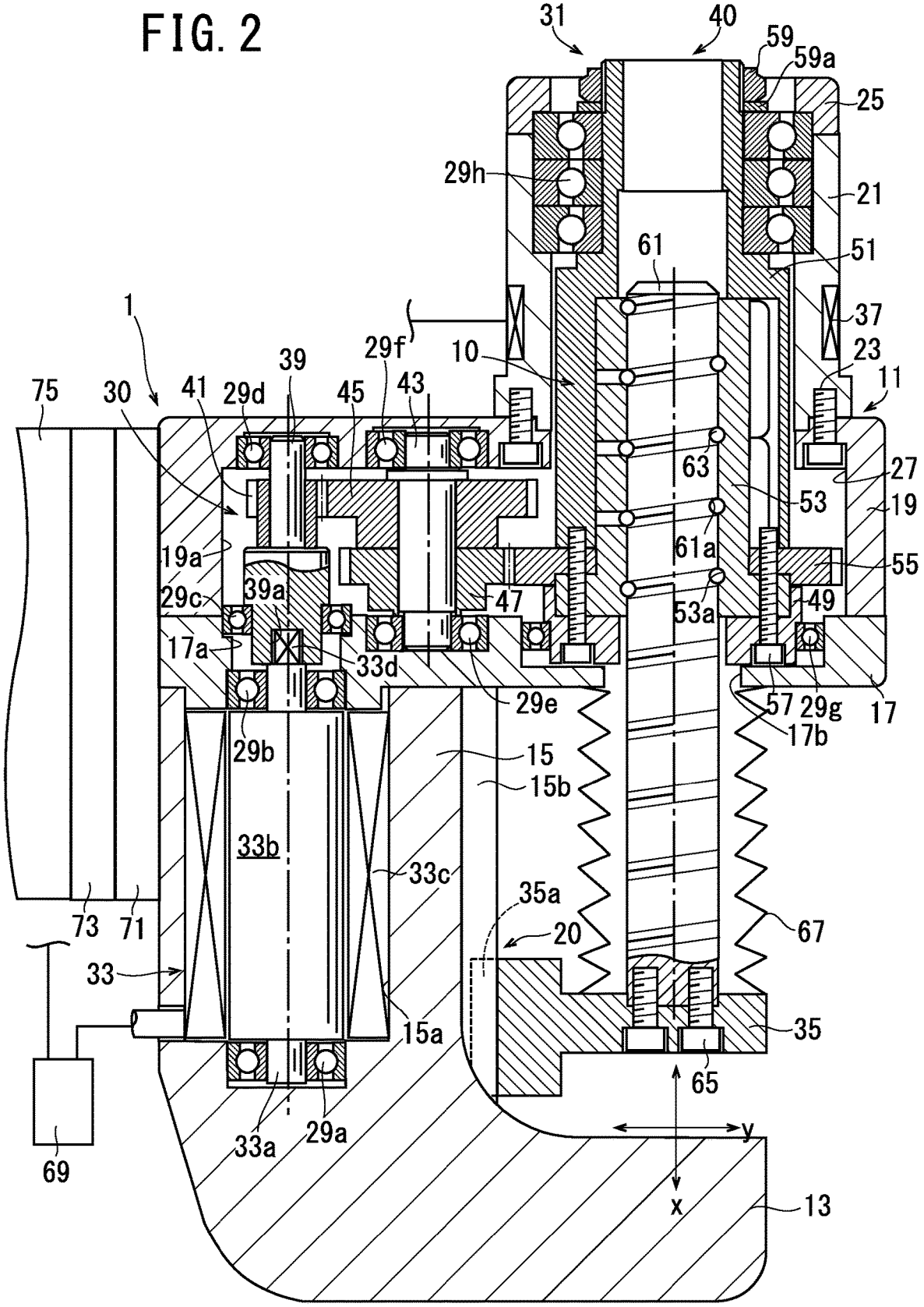
FIG. 2 is a cross-sectional view of the state in which the ram has been lowered, according to the press apparatus of Working Example 1.

As shown in FIGS. 1 and 2, the press apparatus of Working Example 1 comprises a frame 1 and a servopress 31, which is provided on the frame 1.

The frame 1 comprises a first frame part 11, a second frame part 13, which faces the first frame part 11 in a first direction x, and a connecting-frame part (alternately, may be called a frame-connecting part) 15, which connects the first frame part 11 and the second frame part 13. The first frame part 11 and the second frame part 13 extend in a second direction y, which is orthogonal to the first direction x. The frame 1 has a C shape or a U shape overall. Hereinbelow, the first frame part 11 side of the frame 1 is the upper side, and the second frame part 13 side of the frame 1 is the lower side.

The second frame part 13 and the connecting-frame part 15 are integrally cast in an L shape. A motor chamber 15*a*, which is a cavity defined within the connecting-frame part 15 and has a circular-column shape extending in the first direction x, is recessed from the upper surface of the connecting-frame part 15. A first main body 17, which extends in the second direction y, is fastened to the connecting-frame part 15; a second main body 19, which extends in the second direction y, is fastened to the first main body 17. The connecting-frame part 15, the first main body 17, and the second main body 19 are fastened by a plurality of (not-shown) bolts. The first main body 17 and the second main body 19 constitute the first frame part 11.

A bearing housing 21, which extends in a circular-cylinder shape in the first direction x, is fastened, by a plurality of bolts 23, to the second main body 19. In addition, a bearing cover 25, which has a ring shape, is joined to the bearing housing 21.

A first shaft hole 17*a*, which is coaxial with the motor chamber 15*a* and extends in the first direction x, penetrates through the first main body 17; a second shaft hole 17*b*, which is parallel to the first shaft hole 17*a*, penetrates through the first main body 17. A gear chamber 19*a* is formed within the second main body 19. A nut chamber 27, which communicates with the gear chamber 19*a*, is formed within (defined by) the first main body 17, the second main body 19, the bearing housing 21, and the bearing cover 25.

A first bearing 29*a* is provided in the connecting-frame part 15 on the lower side of the motor chamber 15*a*; a second bearing 29*b*, which is coaxial with the first bearing 29*a*, is provided on the motor chamber 15*a* side of the first shaft hole 17*a*. In addition, a third bearing 29*c*, which is coaxial with the first and second bearings 29*a*, 29*b*, is provided in the connecting-frame part 15 on the gear chamber 19*a* side of the first shaft hole 17*a*; a fourth bearing 29*d*, which is coaxial with the first to third bearings 29*a*-29*c*, is provided in the second main body 19.

In addition, a fifth bearing 29*e* is provided in the connecting-frame part 15 such that it is adjacent to the third bearing 29*c*; a sixth bearing 29*f*, which is coaxial with the fifth bearing 29*e*, is provided in the second main body 19 such that it is adjacent to the fourth bearing 29*d*. Furthermore, a seventh bearing 29*g* is provided in the connecting-frame part 15 such that it is adjacent to the fifth bearing 29*e*; an eighth bearing 29*h*, which is coaxial with the seventh bearing 29*g*, is provided in the bearing housing 21 and the bearing cover 25 such that it is adjacent to the sixth bearing 29*f*.

The servopress 31 comprises a servomotor 33, a ram 35, a power-transmission mechanism 40, and a load cell 37. The servomotor 33 comprises a rotary shaft 33*a*, a rotor 33*b*, and a stator 33*c*, which is disposed around the rotor 33*b*. The rotor 33*b* rotates integrally with the rotary shaft 33*a*. The rotary shaft 33*a* is axially supported by the first bearing 29*a* and the second bearing 29*b*. The stator 33*c* is fixed to an inner circumference of the motor chamber 15*a*.

A square-column part 33*d* is formed on the rotary shaft 33*a*, which protrudes into the interior of the first shaft hole 17*a*. A first shaft 39 is axially supported by the third bearing 29*c* and the fourth bearing 29*d*; the square-column part 33*d* of the rotary shaft 33*a* engages with an engaging hole 39*a* of the first shaft 39. A first gear 41 is fixed to the first shaft 39.

A second shaft 43 is axially supported by the fifth bearing 29*e* and the sixth bearing 29*f* A second gear 45 and a third gear 47 are fixed to the second shaft 43. The diameter of the second gear 45 is larger than the diameter of the first gear 41, and also has a higher tooth count. The diameter of the third gear 47 is smaller than the diameter of the second gear 45 and also has a lower tooth count. The second gear 45 meshes with the first gear 41, and the third gear 47 is located on the fifth bearing 29*e* side of the second gear 45.

A turntable 49, which has a circular-cylinder shape, is axially supported by the seventh bearing 29*g*; a nut holder 51, which has a circular-cylinder shape, is axially supported by the eighth bearing 29*h*. Between the turntable 49 and the nut holder 51, a nut 53 and a fourth gear 55 are fixed by a plurality of bolts 57. The turntable 49, the nut 53, the fourth gear 55, and the nut holder 51 are axially supported by the seventh bearing 29*g* and the eighth bearing 29*h*. A female thread is formed on the upper end of the nut holder 51; the eighth bearing 29*h* is sandwiched and held by a nut 59—with a washer 59*a* interposed therebetween-which screws together with the female thread of the nut holder 51, and the nut holder 51. The diameter of the fourth gear 55 is larger than the diameter of the third gear 47 and also has a higher tooth count. The fourth gear 55 meshes with the third gear 47.

A screw shaft 61, which extends in the first direction x, is provided within the nut 53 and the nut holder 51. The load cell 37 is fixed to the bearing housing 21. One thread groove 53*a* is recessed in the inner-circumferential surface of the nut 53, one thread groove 61*a* is recessed also in the outer-circumferential surface of the screw shaft 61, and a plurality of balls 63 is provided in a movable manner between the thread groove 53*a* and the thread groove 61*a*. A circulation passageway, along which the balls 63 circulate, is formed in the nut 53 between the thread groove 53*a* and the thread groove 61*a*.

The ram 35 is fixed, by a plurality of bolts 65, to the lower end of the screw shaft 61. A guide part 15*b*, which extends in the first direction x, is formed on the connecting-frame part 15, and a guided part 35*a*, which is guided by the guide part 15*b*, is formed on the ram 35. The guide part 15*b* has a rail shape, and the guided part 35*a* is configured such that it sandwiches the guide part 15*b* on the near side and the far side of the paper plane. A bellows 67, which is made of rubber, is provided between the first main body 17 and the ram 35. It is configured such that a die or the like may be fixed to the ram 35.

The nut 53, the screw shaft 61, and the plurality of balls 63 constitute a ball-screw mechanism 10. The guide part 15*b* and the guided part 35*a* constitute a linear-motion guide 20, which, while transmitting a load, has a rotation-stopping function, i.e. rotation of the first frame part 11 relative to the second frame part 13 is blocked or prevented while the ram 35 is moving in the vertical direction, e.g., to apply a load (press) a workpiece. The first to eighth bearings 29*a*-29*h*, the first shaft 39, the first gear 41, the second shaft 43, the second gear 45, the third gear 47, and the fourth gear 55 constitute a speed-reducing mechanism 30. The ball-screw mechanism 10, the linear-motion guide 20, and the speed-reducing mechanism 30 constitute the power-transmission mechanism 40.

A controller 69 is connected to the stator 33*c* of the servomotor 33 and to the load cell 37. The servomotor 33 is operated by the controller 69 and causes the rotary shaft 33*a* to rotate. The load cell 37 serves as a load-measuring means and detects the load that acts on the screw shaft 61 via the ram 35, the screw shaft 61, the nut 53, the nut holder 51, the bearing 29*h*, the bearing cover 25, and the bearing housing 21. The controller 69 is connected to a computer, which is not shown. The connecting-frame part 15, the first main body 17, and the second main body 19 are configured such that they are fixed to a robot arm 75 by using plates 71, 73.

While a pressing process is being performed by the press apparatus, the robot arm 75 causes the press apparatus to move to various locations, and the controller 69 causes the servomotor 33 to operate. First, as shown in FIG. 1, the servomotor 33 drives the rotor 33*b* and thereby the rotary shaft 33*a* rotates. The rotation of the rotary shaft 33*a* is transmitted, via the first shaft 39 and the second shaft 43, to the turntable 49, the nut 53, the fourth gear 55, and the nut holder 51. During this interval, the rotational speed of the rotary shaft 33*a* is reduced. Owing to the rotation of the nut 53, as shown in FIG. 2, the screw shaft 61 travels from the first frame part 11 toward the second frame part 13, extending in the first direction x.

Consequently, the ram 35 is guided by the linear-motion guide 20 and descends in the first direction x toward the second frame part 13 in the state in which it is non-rotatable relative to the frame 1. Consequently, it is possible to press, via the die or the like, rivets or the like at various locations. In particular, with regard to this press apparatus, the load cell 37 measures the load that acts on the screw shaft 61 during pressing, and the computer determines acceptability during the pressing based on each load and the movement distance of the ram 35, and records each pressing force. If the servomotor 33 rotates the rotary shaft 33*a* in the reverse direction, then the ram 35 ascends in the first direction x such that it moves away from the second frame part 13.

During this interval, with regard to the press apparatus, because the servomotor 33 is provided within the connecting-frame part 15 and because the speed-reducing mechanism 30 of the power-transmission mechanism 40 is provided within the first frame part 11, only a portion of the ball-screw mechanism 10 protrudes from the frame 1. The linear-motion guide 20 is irrelevant to a size increase of the frame 1. In particular, with regard to this press apparatus, the ball-screw mechanism 10, which is widely used in well-known servopresses, constitutes the power-transmission mechanism 40. In addition, because the nut 53 is rotationally driven by the rotary shaft 33*a*, the overall length of the ball-screw mechanism 10 of the power-transmission mechanism 40 can be shortened more than an embodiment in which the screw shaft 61 is rotationally driven by the rotary shaft 33*a*. In addition, the screw shaft 61 is integral with the ram 35, and a linear-motion mechanism is constituted by the linear-motion guide 20, which is simple. Consequently, simplification of the structure is achieved. In addition, in this press apparatus as well, the load on the ram 35 during pressing can be measured through (using) the load that acts on the screw shaft 61.

Accordingly, the press apparatus of Working Example 1 is capable of assuring the acceptability of the pressing, is more compact than those in the past, and tends not to be limited with respect to the pressing location. Consequently, even though this press apparatus is provided on the robot arm 75, limitations on the movement of the robot arm 75 tend not to occur, and pressure can be applied to rivets or the like at various locations.

In addition, with regard to this press apparatus, because the connecting-frame part 15 fixes the stator 33*c* and because the connecting-frame part 15 also serves as a motor housing, a motor housing becomes unnecessary, and therefore a reduction in manufacturing cost can be achieved owing to a reduction in the part count.

Working Example 2

Figure 3:
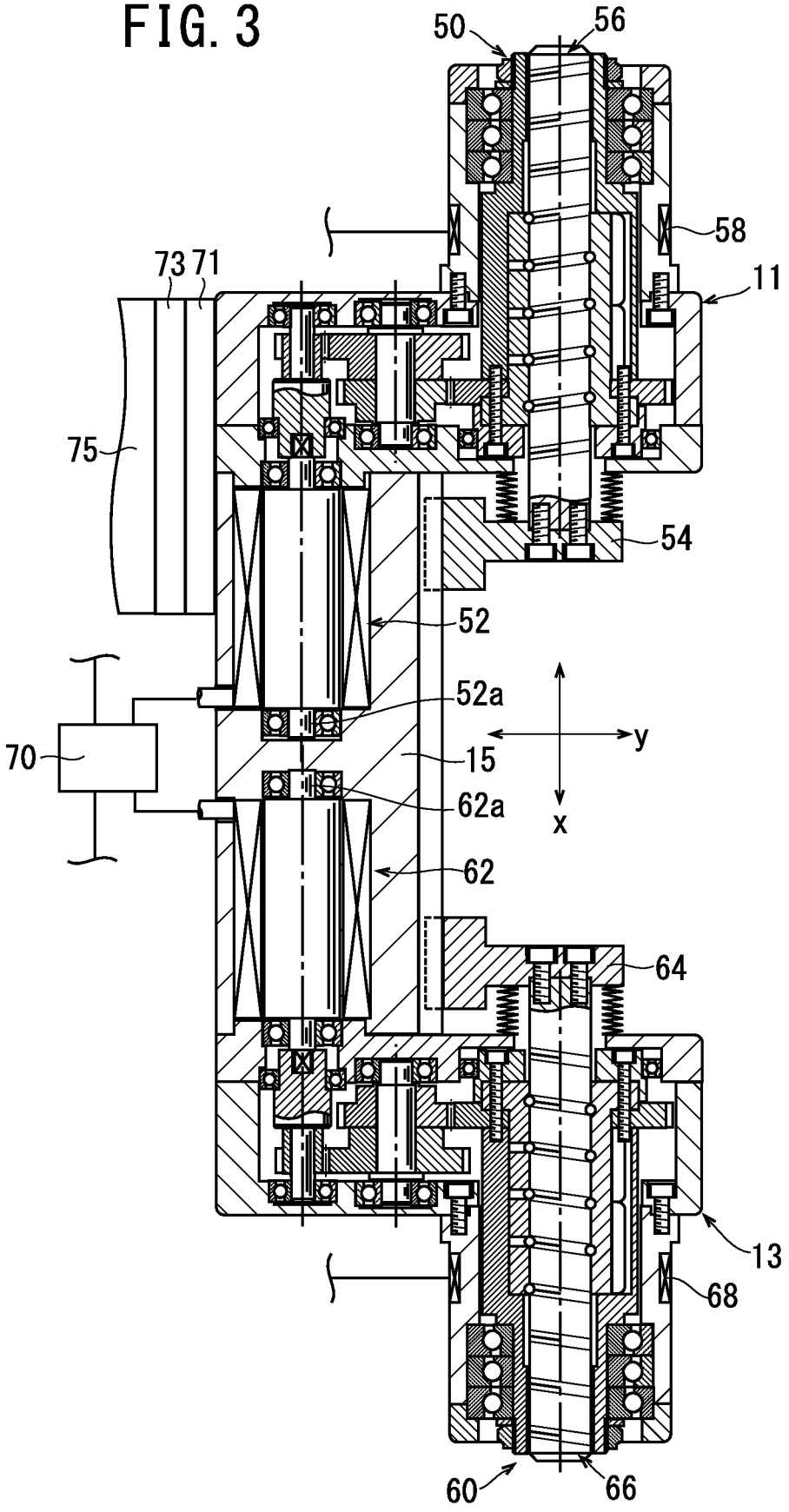
FIG. 3 is a cross-sectional view of a press apparatus of Working Example 2 of the present teachings.

As shown in FIG. 3, a press apparatus of Working Example 2 comprises first and second servopresses 50, 60. The first servopress 50 is the same as the servopress 31 of Working Example 1; the second servopress 60 is the servopress 31 of Working Example 1 vertically inverted and is provided on the second frame part 13.

The first servopress 50 comprises: a first servomotor 52, which causes a first rotary shaft 52*a* to rotate; a first ram 54, which is capable of reciprocating motion in the first direction x between the first frame part 11 and the second frame part 13; a first power-transmission mechanism 56, which converts the rotation of the first rotary shaft 52*a* into reciprocating motion of the first ram 54; and a first load cell 58, which is capable of measuring the load on the first ram 54.

The second servopress 60 comprises: a second servomotor 62, which causes a second rotary shaft 62*a* to rotate; a second ram 64, which is capable of reciprocating motion in the first direction x between the first frame part 11 and the second frame part 13; a second power-transmission mechanism 66, which converts the rotation of the second rotary shaft 62*a* into reciprocating motion of the second ram 64; and a second load cell 68, which is capable of measuring the load on the second ram 64.

A controller 70 is connected to the stator of the first servomotor 52 and to the first load cell 58 and is connected to the stator of the second servomotor 62 and to the second load cell 68. The first and second servomotors 52, 62 are operated by the controller 70 and cause the first and second rotary shafts 52*a*, 62*a* to rotate synchronously. At this time, the first and second servomotors 52, 62 may be operated synchronously and may be operated such that, in accordance with the workpiece, after one of the first and second servomotors 52, 62 operates and makes contact with the workpiece, the other of the first and second servomotors 52, 62 begins to operate. The first load cell 58 detects the load that acts on the screw shaft via the first ram 54, and the second load cell 68 detects the load that acts on the screw shaft via the second ram 64. The connecting-frame part 15 and the first frame part 11 are configured such that they are fixed to the robot arm 75 by using the plates 71, 73. The first ram 54 and the second ram 64 face one another.

With regard to the press apparatus of Working Example 2, it is possible to press the workpiece from both sides using the first ram 54 and the second ram 64. Other functions and effects are the same as those in Working Example 1.

Working Example 3

Figure 4:
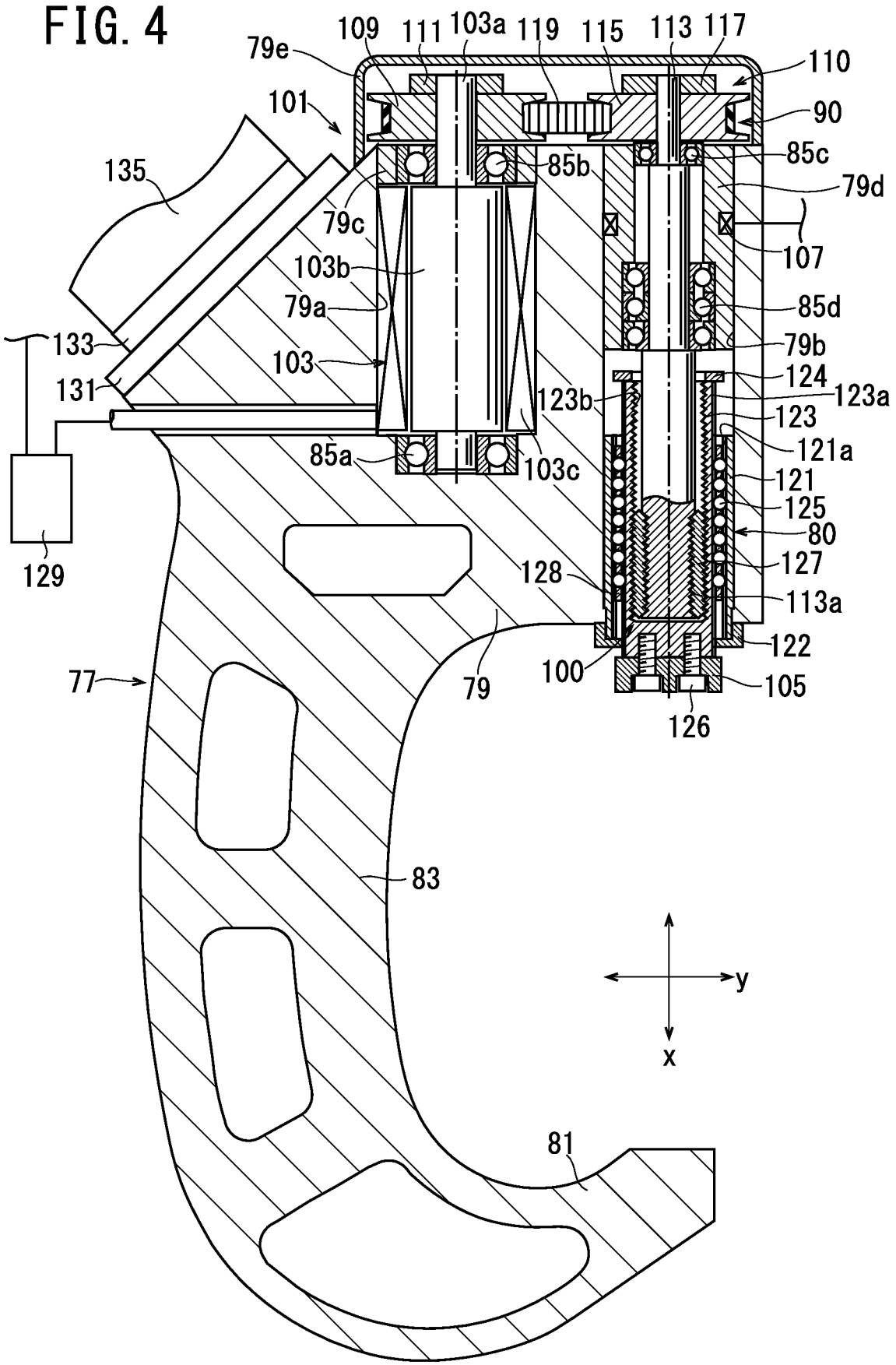
FIG. 4 is a cross-sectional view of the state in which the ram has been raised, according to a press apparatus of Working Example 3 of the present teachings.
Figure 5:
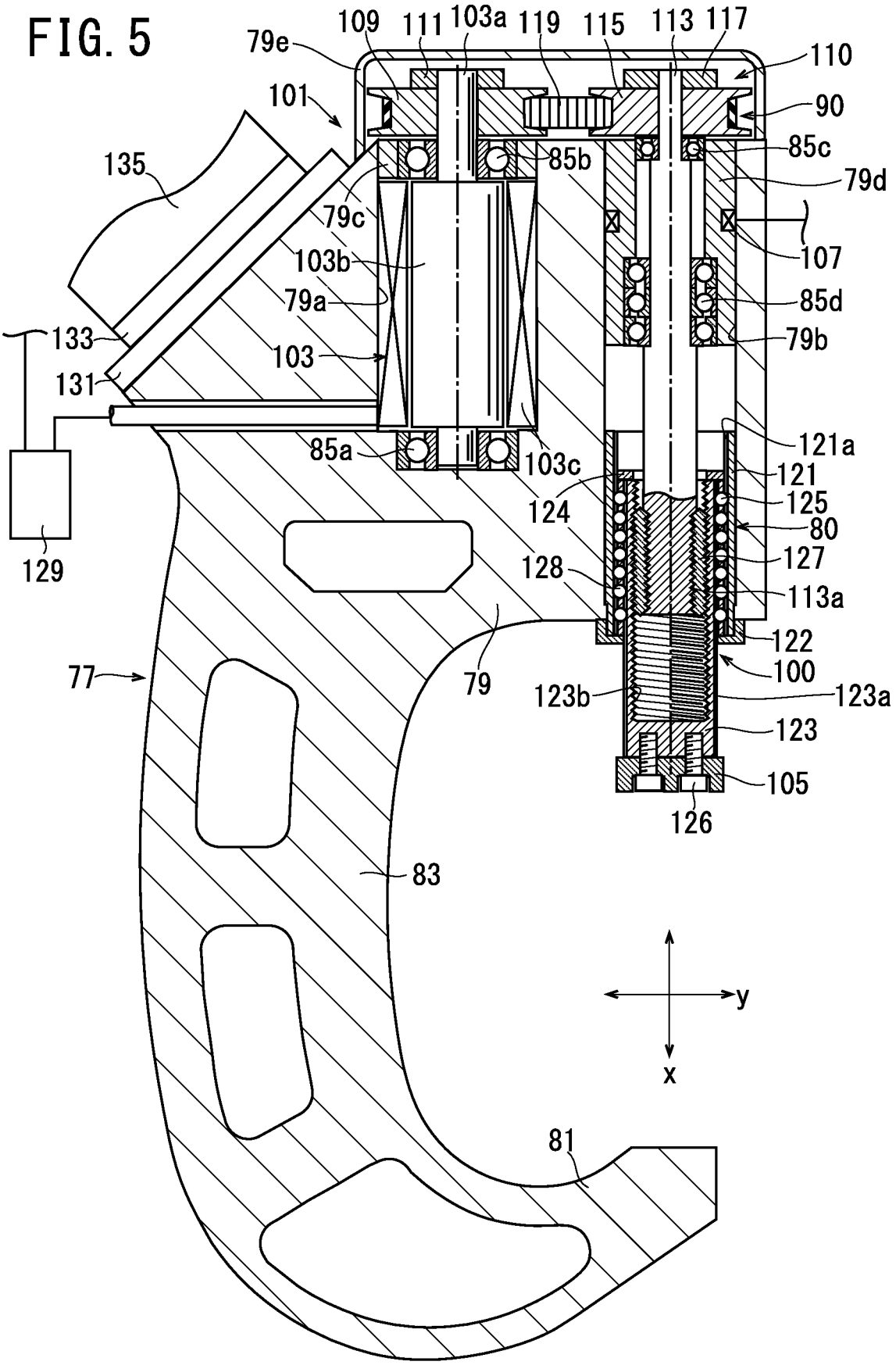
FIG. 5 is a cross-sectional view of the state in which the ram has been lowered, according to the press apparatus of Working Example 3.

As shown in FIG. 4 and FIG. 5, a press apparatus of Working Example 3 comprises a frame 77 and a servopress 101, which is provided on the frame 77.

The frame 77 comprises a first frame part 79, a second frame part 81, which faces the first frame part 79 in the first direction x, and a connecting-frame part (frame-connecting part) 83, which connects the first frame part 79 and the second frame part 81. The first frame part 79 and the second frame part 81 extend in the second direction y, which is orthogonal to the first direction x. Hereinbelow, the first frame part 79 side of the frame 77 is referred to as the upper side, and the second frame part 81 side of the frame 77 is referred to as the lower side.

The first frame part 79, the second frame part 81, and the connecting-frame part 83 are cast integrally in a C shape or a U shape overall. A motor chamber 79*a*, which is a cavity defined within a circular-column shape extending in the first direction x, and a nut chamber 79*b*, which is a cavity defined within a circular-column shape extending parallel to the motor chamber 79*a*, are recessed in the first frame part 79 from the upper surface of the first frame part 79.

A first bearing 85*a* is provided in the first frame part 79 on the lower side of the motor chamber 79*a*; a first spacer 79*c* is fixed to the upper side of the motor chamber 79*a*; and a second bearing 85*b*, which is coaxial with the first bearing 85*a*, is provided in the first spacer 79*c*. In addition, a second spacer 79*d* is fixed to the first frame part 79 on the upper side of the nut chamber 79*b*; a third bearing 85*c* and a fourth bearing 85*d*, which is coaxial with the third bearing 85*c*, are provided in the second spacer 79*d*. The first spacer 79*c* and the second spacer 79*d* are a portion of the first frame part 79.

The servopress 101 comprises a servomotor 103, a ram 105, a power-transmission mechanism 110, and a load cell 107. The servomotor 103 comprises a rotary shaft 103*a*, a rotor 103*b*, and a stator 103*c*, which is disposed around the rotor 103*b*. The rotor 103*b* rotates integrally with the rotary shaft 103*a*. The rotary shaft 103*a* is axially supported by the first bearing 85*a* and the second bearing 85*b*. The stator 103*c* is fixed to the inner circumference of the motor chamber 79*a*.

A first pulley 109 is fixed to the rotary shaft 103*a*, which protrudes upward from the motor chamber 79*a*; the first pulley 109 is retained by a fastener 111, which engages with the rotary shaft 103*a*. Within the second spacer 79*d*, a screw shaft 113 is axially supported by the third bearing 85*c* and the fourth bearing 85*d*. A second pulley 115 is fixed to the screw shaft 113, which protrudes upward from the nut chamber 79*b*; the second pulley 115 is retained by a fastener 117, which engages with the screw shaft 113. A timing belt 119 is looped around the first pulley 109 and the second pulley 115. A cover 79*e*, which covers the first pulley 109, the second pulley 115, the timing belt 119, etc., is fixed to the upper end of the first frame part 79. The cover 79*e* is a portion of the first frame part 79.

A third spacer 121 is fixed in the lower side of the nut chamber 79*b*. The third spacer 121 is also a portion of the first frame part 79. First ball grooves 121*a*, which extend in the first direction x, are recessed in the inner-circumferential surface of the third spacer 121.

A nut 123 is disposed within the third spacer 121. The nut 123 has a bottomed, circular-cylinder shape. It is also possible to use a nut having a circular-cylinder shape. Second ball grooves 123*a*, which extend in the first direction x, are recessed in the outer-circumferential surface of the nut 123. A plurality of balls 125 is provided between the first ball groove 121*a* and the second ball groove 123*a*. The balls 125 are held by a ball cage 128. The first ball grooves 121*a*, the balls 125, and the second ball grooves 123*a* constitute a ball spline 80, which, while transmitting a load, has a rotation-stopping function.

A stopper 124, which has a ring shape, is fixed to an upper surface of the nut 123. The outer diameter of the stopper 124 is larger than the diameter of the second ball grooves 123*a* and is smaller than the diameter of the first ball grooves 121*a*. Consequently, the nut 123 is movable within the third spacer 121 until the stopper 124 makes contact with the ball cage 128.

A ball holder 122, which has a ring shape and makes contact with the lower end of the third spacer 121, is fixed to a lower surface of the first frame part 79. The inner diameter of the ball holder 122 is larger than the diameter of the second ball grooves 123*a* and is smaller than the diameter of the first ball grooves 121*a*. Consequently, the ball cage 128 is configured such that, owing to the ball holder 122, it will not drop.

A female thread 123*b* is formed in the inner-circumferential surface of the nut 123. The screw shaft 113 extends into the nut 123. A male thread 113*a* is formed on the outer-circumferential surface of a lower portion of the screw shaft 113. A plurality of planetary-roller screws 127 is provided between the nut 123 and the screw shaft 113. Each of the planetary-roller screws 127 screws together with the female thread 123*b* of the nut 123 and the male thread 113*a* of the screw shaft 113. Each of the planetary-roller screws 127 is configured such that, owing to a not-shown holder, angles with respect to each other around the screw shaft 113 are maintained. The ram 105 is fixed, by a plurality of bolts 126, to the lower end of the nut 123.

The first to fourth bearings 85*a*-85*d*, the first pulley 109, the second pulley 115, and the timing belt 119 constitute a constant-velocity mechanism 90. The nut 123, the screw shaft 113, and the planetary-roller screws 127 constitute a planetary-roller screw mechanism 100. The planetary-roller screw mechanism 100, the ball spline 80, and the constant-velocity mechanism 90 constitute the power-transmission mechanism 110.

A controller 129 is connected to the stator 103*c* of the servomotor 103 and to the load cell 107. The servomotor 103 is operated by the controller 129 and causes the rotary shaft 103*a* to rotate. The first frame part 79 is configured such that it is fixed to a robot arm 135 by using plates 131, 133. Other structural elements are the same as those in the press apparatus according to Working Example 1.

While the pressing process is being performed by this press apparatus, too, the robot arm 135 causes the press apparatus to move to various locations, and the controller 129 causes the servomotor 103 to operate. First, as shown in FIG. 4, the servomotor 103 drives the rotor 103*b*, and thereby the rotary shaft 103*a* rotates. The rotation of the rotary shaft 103*a* is transmitted to the screw shaft 113 via the first pulley 109, the timing belt 119, and the second pulley 115. Owing to the rotation of the screw shaft 113, as shown in FIG. 5, the nut 123 travels from the first frame part 79 toward the second frame part 81, extending in the first direction x.

Consequently, the ram 105 is guided by the ball spline 80 and, in the state in which it is non-rotatable relative to the frame 77, descends in the first direction x toward the second frame part 81. Consequently, it is possible to press, using a die or the like, rivets or the like at various locations. If the servomotor 103 rotates the rotary shaft 103*a* in the reverse direction, then the ram 105 ascends in the first direction x such that it moves away from the second frame part 81.

During this interval, with regard to this press apparatus, because the servomotor 103 is provided within the first frame part 79 and the power-transmission mechanism 110 is provided within the first frame part 79, the power-transmission mechanism 110 does not protrude from the frame 77. In addition, the ball spline 80, which has a small volume, constitutes a linear-motion mechanism. In particular, with regard to this press apparatus, the planetary-roller screw mechanism 100 can transmit a large load, and thereby the load that can be applied can be made large. In addition, because the pitch (lead) of the planetary-roller screw mechanism 100 is fine, a speed-reducing mechanism becomes unnecessary, and thereby a more compact press apparatus can be achieved.

Accordingly, this press apparatus of Working Example 3 is capable of assuring the acceptability of the pressing, is compact, tends not to be limited with respect to the pressing location, and moreover can perform a higher quality pressing process. Other functions and effects are the same as those in Working Example 1.

Preferred aspects of the present teachings were explained above based on Working Examples 1-3, but the present invention is not limited to Working Examples 1-3 and it goes without saying the present invention can be modified as appropriate within a range that does not depart from the gist thereof.

For example, in Working Examples 1-3, the load cells 37, 58, 68, 107 are used as the load-measuring means; however, it is also possible to use other sensors such as dynamic sensors or force sensors or to measure the load on the rotary shafts 33*a*, 52*a*, 62*a*, 103*a* using an electric-current value, which can be measured at the servomotors 33, 52, 62, 103.

In Working Example 2, two of the servopresses 31 of Working Example 1 are used, but it is also possible to use two of the servopresses 101 of Working Example 3.

The power-transmission mechanism is not limited to the ball-screw mechanism 10 or to the planetary-roller screw mechanism 100, and it is also possible to use other mechanisms. In addition, the speed-reducing mechanism and the constant-velocity mechanism are not limited to mechanisms that use gears or a belt as in Working Examples 1 3, and it is also possible to use other mechanisms in which a chain or the like is used.

In Working Examples 1, 2, the guide part 15*b* may be provided indirectly on the frame 1, and the guided part 35*a* also may be provided indirectly on the screw shaft 61 or the ram 35. In addition, in Working Example 3, the first ball grooves 121*a* may be provided directly on the first frame part 79, and the second ball grooves 123*a* also may be provided indirectly on the nut 123. It is also possible to use mechanisms other than the linear-motion guide 20 or the ball spline 80 as the linear-motion mechanism.

In Working Examples 1 and 2, the second frame part 13 and the connecting-frame part 15 are cast integrally, but it is also possible to make these separate and integrate (join) them using bolts or the like. In addition, the second frame part 13, the connecting-frame part 15, the first main body 17, and the second main body 19 are not limited to being separate bodies and may be integrated (integral) as long as their structures are established.

A ball-screw mechanism may constitute the power-transmission mechanism and a screw shaft may be rotationally driven by a rotary shaft, or a planetary-roller screw mechanism may constitute the power-transmission mechanism and a nut may be rotationally driven by a rotary shaft.

The servomotor is not limited to being the inner-rotor type used in Working Examples 1-3 and may instead be an outer-rotor type.

The present teachings can be used, e.g., in a riveting apparatus, plastic working, and the like.

EXPLANATION OF THE REFERENCE NUMBERS

11, 17, 19, 79 First frame parts (17: first main body, 19: second main body)
x First direction
13, 81 Second frame parts
15, 83 Connecting-frame parts
1, 77 Frames
33*a*, 52*a*, 62*a*, 103*a* Rotary shafts
33, 52, 62, 103 Servomotors
35, 54, 64, 105 Rams
40, 56, 66, 90, 110 Power-transmission mechanisms (10: ball-screw mechanism, 30: speed-reducing mechanism, 90: constant-velocity mechanism, 100: planetary-roller screw mechanism)
37, 58, 68, 107 Load-measuring means (load cells)
31, 50, 60, 101 Servopresses
53, 123 Nuts
61, 113 Screw shafts
63, 125 Balls
20, 80 Linear-motion mechanisms (20: linear-motion guide, 80: ball spline)
15*b* Guide part
35*a* Guided part
127 Planetary-roller screw
121*a* First ball groove
123*a* Second ball groove
33*b*, 103*b* Rotors
33*c*, 103*c* Stators

The invention claimed is:

1. A press apparatus comprising:
a frame that comprises a first frame part, a second frame part, which faces the first frame part in a first direction, and a connecting-frame part, which connects the first frame part and the second frame part; and
a servopress, which is provided on the frame, comprising a servomotor, which causes a rotary shaft to rotate, a ram, which is capable of reciprocating motion in the first direction between the first frame part and the second frame part, a power-transmission mechanism that converts the rotation of the rotary shaft into reciprocating motion of the ram, and a load-measuring means that is capable of measuring a load on the ram;
wherein:
the frame is fixed to a robot arm;
the servomotor is accommodated in a motor chamber defined within the first frame part or within the connecting-frame part; and
at least a portion of the power-transmission mechanism is provided within the first frame part.

2. The press apparatus according to claim 1, wherein:
the power-transmission mechanism comprises:
a ball-screw mechanism that comprises a nut extending in the first direction, a screw shaft extending in the first direction within the nut, and a plurality of balls disposed between the nut and the screw shaft; and
a linear-motion mechanism configured to block rotation while a load is being transmitted;
the ball-screw mechanism is provided within the first frame part;
one of the nut and the screw shaft is rotationally driven by the rotary shaft; and
the other of the nut and the screw shaft is formed integrally with the ram in the state in which it is non-rotatable relative to the frame owing to the linear-motion mechanism.

3. The press apparatus according to claim 2, wherein:
the nut is rotationally driven by the rotary shaft, and
the linear-motion mechanism is a linear-motion guide that comprises a guide part provided on the frame and extending in the first direction and a guided part provided on the screw shaft or the ram and guided by the guide part.

4. The press apparatus according to claim 2, wherein:
the power-transmission mechanism comprises a speed-reducing mechanism that transmits rotation of the rotary shaft to the ball-screw mechanism; and
the speed-reducing mechanism is disposed within the first frame part.

5. The press apparatus according to claim 4, wherein:
the nut is rotationally driven by the rotary shaft; and
the linear-motion mechanism is a linear-motion guide that comprises a guide part provided on the frame and extending in the first direction and a guided part provided on the screw shaft or the ram and guided by the guide part.

6. The press apparatus according to claim 1, wherein:
the power-transmission mechanism comprises:
a planetary-roller screw mechanism that comprises a nut extending in the first direction, a screw shaft extending in the first direction within the nut, and a plurality of planetary-roller screws disposed between the nut and the screw shaft; and
a linear-motion mechanism configured to block rotation while a load is being transmitted;
the planetary-roller screw mechanism is provided within the first frame part;
one of the nut and the screw shaft is rotationally driven by the rotary shaft; and
the other of the nut and the screw shaft is formed integrally with the ram in the state in which it is non-rotatable relative to the frame owing to the linear-motion mechanism.

7. The press apparatus according to claim 6, wherein:
the screw shaft is rotationally driven by the rotary shaft;
the linear-motion mechanism is a ball spline comprising a first ball groove provided on the first frame part and extending in the first direction, a second ball groove provided on the nut and extending in the first direction, and a plurality of balls provided between the first ball groove and the second ball groove; and
the linear-motion mechanism is provided within the first frame part.

8. The press apparatus according to claim 6, wherein:
the power-transmission mechanism comprises a constant-velocity mechanism that transmits rotation of the rotary shaft to the planetary-roller screw mechanism; and the constant-velocity mechanism is disposed within the first frame part.

9. The press apparatus according to claim 8, wherein:

the screw shaft is rotationally driven by the rotary shaft;

the linear-motion mechanism is a ball spline comprising a first ball groove provided on the first frame part and extending in the first direction, a second ball groove provided on the nut and extending in the first direction, and a plurality of balls provided between the first ball groove and the second ball groove; and the linear-motion mechanism is provided within the first frame part.

10. The press apparatus according to claim 1, wherein:

the servomotor comprises a rotor, which rotates integrally with the rotary shaft, and a stator; and the stator is fixed in the connecting-frame part or the first frame part.

11. The press apparatus according to claim 1, further comprising:

a second servopress, which is provided on the frame, comprising a second servomotor, which causes a second rotary shaft to rotate, a second ram, which is capable of reciprocating motion in the first direction between the first frame part and the second frame part, a second power-transmission mechanism, which converts the rotation of the second rotary shaft into reciprocating motion of the second ram, and a second load-measuring means, which is capable of measuring a load on the second ram;

wherein the ram and the second ram face one another.

* * * * *